US006799338B1

(12) United States Patent
Hsia

(10) Patent No.: US 6,799,338 B1
(45) Date of Patent: Oct. 5, 2004

(54) PORTABLE PLAYYARD

(76) Inventor: Ben Ming Hsia, 10671 Lanark St., Sun Valley, CA (US) 91352

( * ) Notice: Subject to any disclaimer, the term of this patent is extended or adjusted under 35 U.S.C. 154(b) by 0 days.

(21) Appl. No.: 10/465,671

(22) Filed: Jun. 20, 2003

(51) Int. Cl.[7] ..... A47D 13/06
(52) U.S. Cl. ..... 5/93.1; 5/98.1; 5/945
(58) Field of Search ..... 5/93.1, 98.1, 99.1, 5/945

(56) References Cited

U.S. PATENT DOCUMENTS 2,854,049 A * 9/1958 Spencer ..... 220/565
6,588,028 B1 * 7/2003 Wu ..... 4/506

* cited by examiner

*Primary Examiner*—Teri Pham Luu
(74) *Attorney, Agent, or Firm*—Raymond Y. Chan; David and Raymond Patent Group

(57) ABSTRACT

A portable playyard includes a top frame defining a top opening, a bottom frame, a plurality of circular inflatable supporters spacedly bridging the top and bottom frames, a boundary shelter supported by the top frame to define a playyard cavity within the boundary shelter, the top frame, and the bottom frame; and an air valve provided at the inflatable supporters. Each of the inflatable supporters, having an air chamber, is outwardly and inclinedly extended from the top frame to the bottom frame to evenly distribute and support a downward force applied on the top frame so as to prevent the playyard from being accidentally collapsed.

10 Claims, 7 Drawing Sheets

PORTABLE PLAYYARD

BACKGROUND OF THE PRESENT INVENTION

1. Field of Invention

The present invention relates to a playyard, and more particularly to a portable playyard which can be inflated to form an air-cushioning boundary for accommodating infants or children to play therein.

2. Description of Related Arts

A playyard provides a safe place for infants and children to play therein. For ease of storage, many playyards are made in portable forms. A conventional playyard will be introduced to explain the current practice in this particular technical area. The problems of the current practice will be discussed to establish the need of technical improvement.

As shown in FIG. 1, a conventional playyard comprises an upper boundary frame, a lower boundary frame, and four vertical posts spacedly mounted between the upper and lower boundary frames to support a cloth boundary that a baby or a young child can dispose therein. In order to restrict the movement of the baby within the areas, the vertical posts must be high enough that the baby cannot climb out of the playyard.

In order to fold up the playyard, a plurality of joints and couplers are employed to interconnect the adjoining ends of the frame sections which, in turn, confine looped frames for forming a playyard frame. Moreover, locking devices are employed to prevent folding of the adjoining frame sections. However, accidental actuation of the locking device may occur, thereby resulting in folding of the frame sections relative to each other, which action may injure a child playing in the foldable playyard.

Thus, in order to enhance the foldable ability of the playyard, more joints must be employed such that the playyard can be folded up in a compact unit for carriage and storage. However, the complicated foldable frame will highly increase the manufacturing cost of the playyard and weaken the rigid structure of the frame. Furthermore, it is a hassle for a user, such as parent, to manipulate the folding and unfolding operations of the playyard.

Another problem of the conventional playyard is the concern of safety. In order to provide structural strength, the boundary frames and the vertical posts are usually made of rigid materials, such as metal. Bruises are frequently inflicted to a child due to his or her contact with the posts and joints when the child plays within the playyard. Cuts may also happen to the child because of the sharp edges of the screws, bolts, and joints. Therefore, a cushion layer must be additionally added into the interior of the playyard to protect the child colliding with the frame. In addition, the additional joints, couplers, and cushion layer will substantially increase the overall weight of the playyard to reduce the portability of the playyard.

As a result of the above-mentioned problems, what is need is portable playyard with lightweight, having a soft but substantially strong structure protecting infants and children from infliction of bruises and cuts when they play inside.

SUMMARY OF THE PRESENT INVENTION

A main object of the present invention is to provide a portable playyard which can be inflated to form an air-cushioning boundary for accommodating infants or children to play therein.

Another object of the present invention is to provide a portable playyard, which comprises a plurality of inflatable supporters spacedly bridging the top and bottom boundary frames, wherein each of the inflatable supporters has a cross section gradually increased from the upper portion to the lower portion to provide a rigid, simple and strong structure so as to minimize the deformation of inflatable supporter, so as to prevent the playyard from being accidentally collapsed.

Another object of the present invention is to provide a portable playyard, wherein each of the inflatable supporters is inclinedly extended from the top boundary frame to the bottom boundary frame to evenly distribute and support a downward force applied on the upper boundary frame so as to further prevent the playyard from being accidentally collapsed.

Another object of the present invention is to provide a portable playyard, wherein each of the inflatable supporters inevitably provides an air-cushioning effect for the portable playyard so that the child is safe to accommodate in the portable playyard.

Another object of the present invention is to provide a portable playyard, which can be quickly and easily folded into a compact unit for carriage and storage and unfolded for use. In other words, the present invention does not require a relatively large storage space in comparison with the conventional foldable frame, so as to minimize the cost of shipping and handling of the present invention.

Another object of the present invention is to provide a portable playyard, wherein due to the inflatable properties, the portable playyard is extremely lightweight in comparison with the conventional playyard incorporating with metal posts and joints. In other words, the portable playyard is capable of being deflated to enhance the portability of the present invention.

Another object of the present invention is to provide a portable playyard, wherein the folding and unfolding operations of the present invention are easy and fast by deflating and inflating the portable playyard respectively, such that an individual is able to unfold or fold up the portable playyard.

Another object of the present invention is to provide a portable playyard, wherein no expensive or complicated structure is required to employ in the present invention in order to achieve the above mentioned objects. Therefore, the present invention successfully provides an economic and efficient solution not only for providing a rigid configuration for the playyard but also for providing an air-cushioning effect to protect infants and children from infliction of bruises and cuts.

Accordingly, in order to accomplish the above objects, the present invention provides a portable playyard, comprising:

a top frame defining a top opening;

a bottom frame positioning underneath the top frame;

a plurality of circular inflatable supporters spacedly bridging the top and bottom frames and defining an interior space between the top and bottom frames, wherein each of the inflatable supporters, having an air chamber, outwardly and inclinedly extended from the top frame to the bottom frame to define an interior adjacent angle and an exterior adjacent angle which is smaller than the interior adjacent angle, wherein the interior adjacent angle is defined between an interior peripheral edge of the respective inflatable supporter and the bottom frame, wherein the exterior adjacent angle is defined between an exterior peripheral edge of the respective inflatable supporter and the bottom frame, wherein a diameter of each of the inflatable supporters is gradually increased from a top portion of the inflatable supporter to a bottom portion thereof;

a boundary shelter supported by the top frame to surround the interior space and define a playyard cavity within the boundary shelter, the top frame, and the bottom frame; and at least an air valve provided at the inflatable supporters for retaining a predetermined volume of air within the air chamber of each of the inflatable supporters.

These and other objectives, features, and advantages of the present invention will become apparent from the following detailed description, the accompanying drawings, and the appended claims.

DETAILED DESCRIPTION OF THE PREFERRED EMBODIMENT

Figure 1:
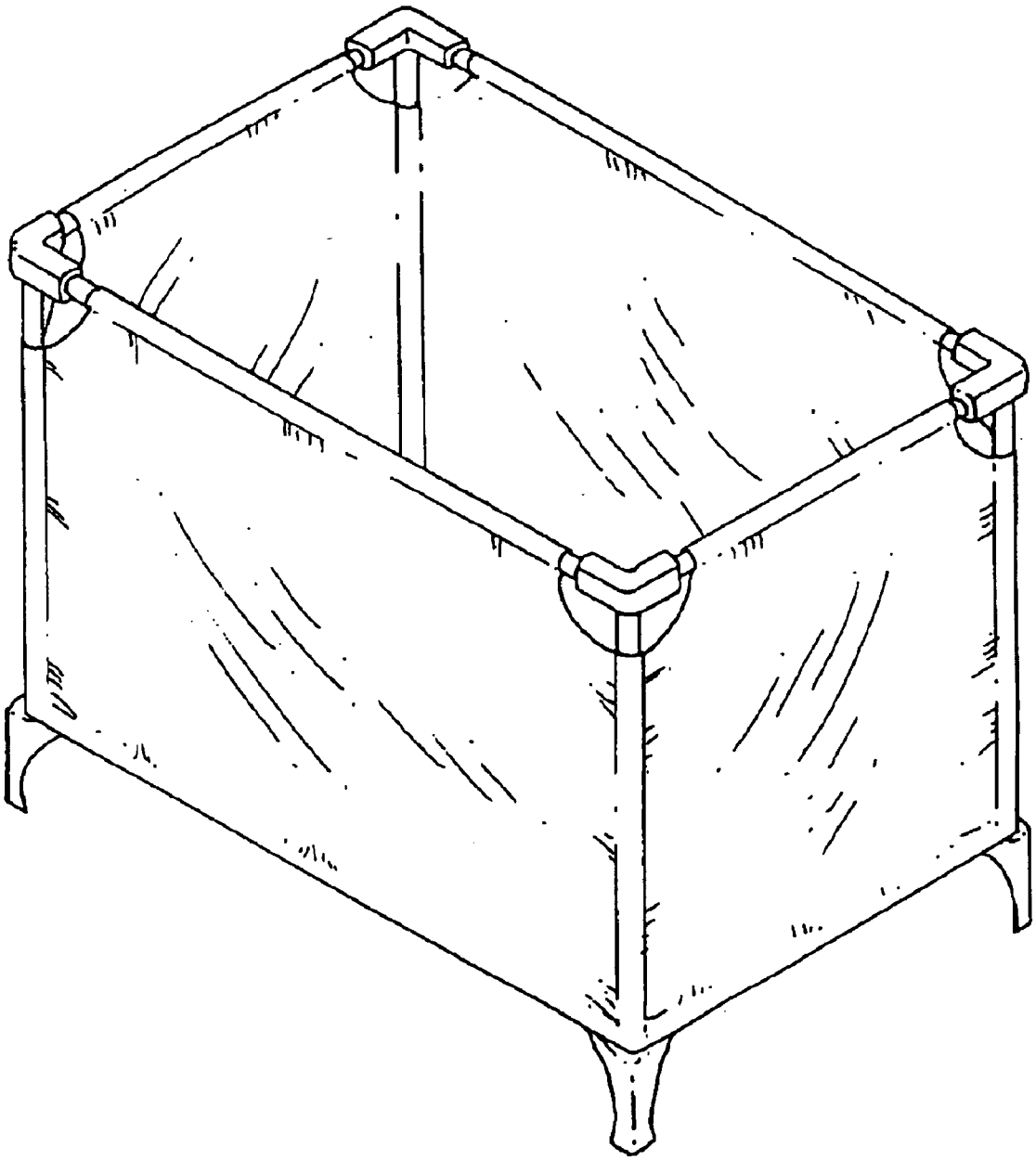
FIG. 1 PRIOR ART
FIG. 1 is a perspective view of a conventional playyard.
Figure 2:
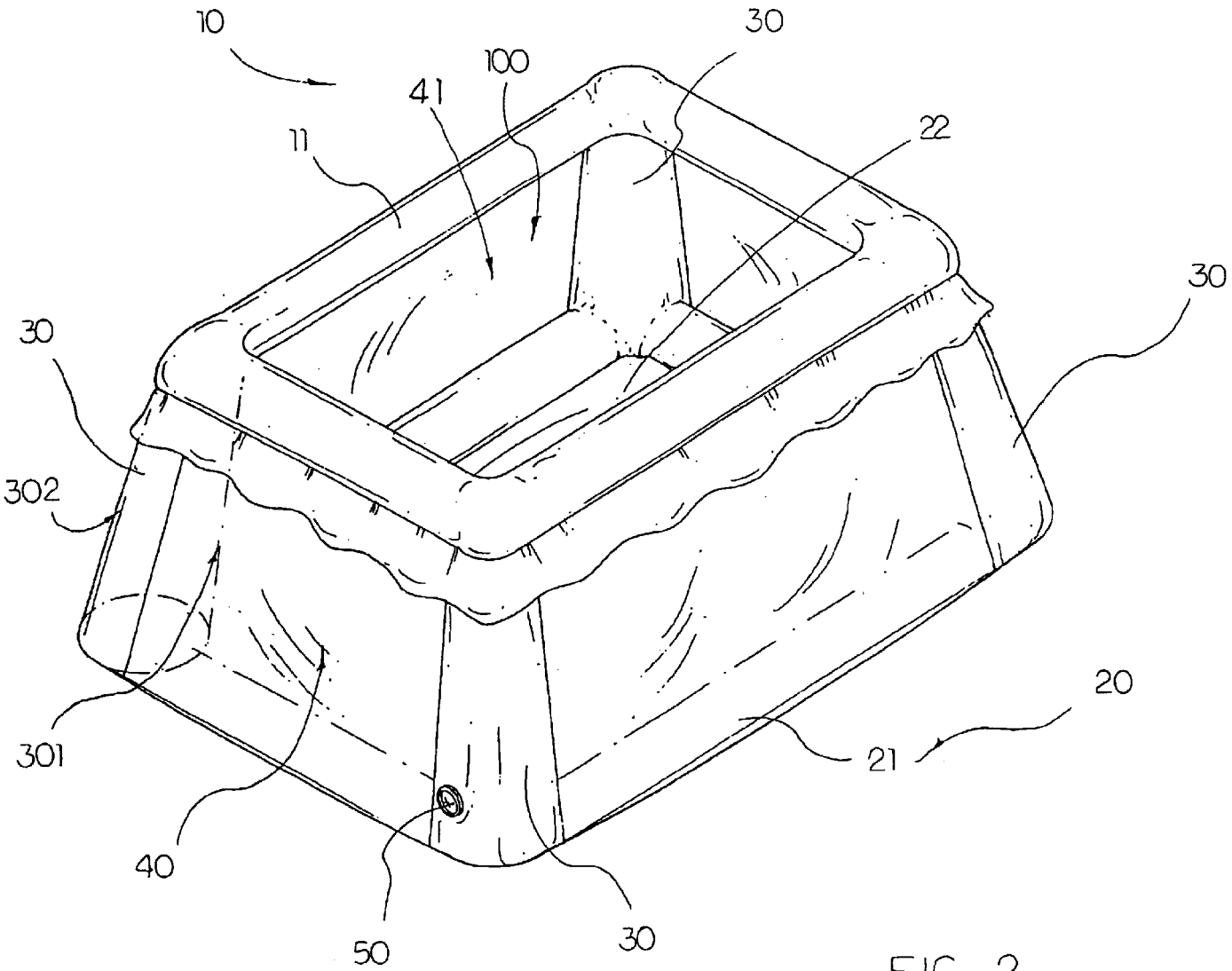
FIG. 2 is a perspective view of a portable playyard according to a preferred embodiment of the present invention.
Figure 3:
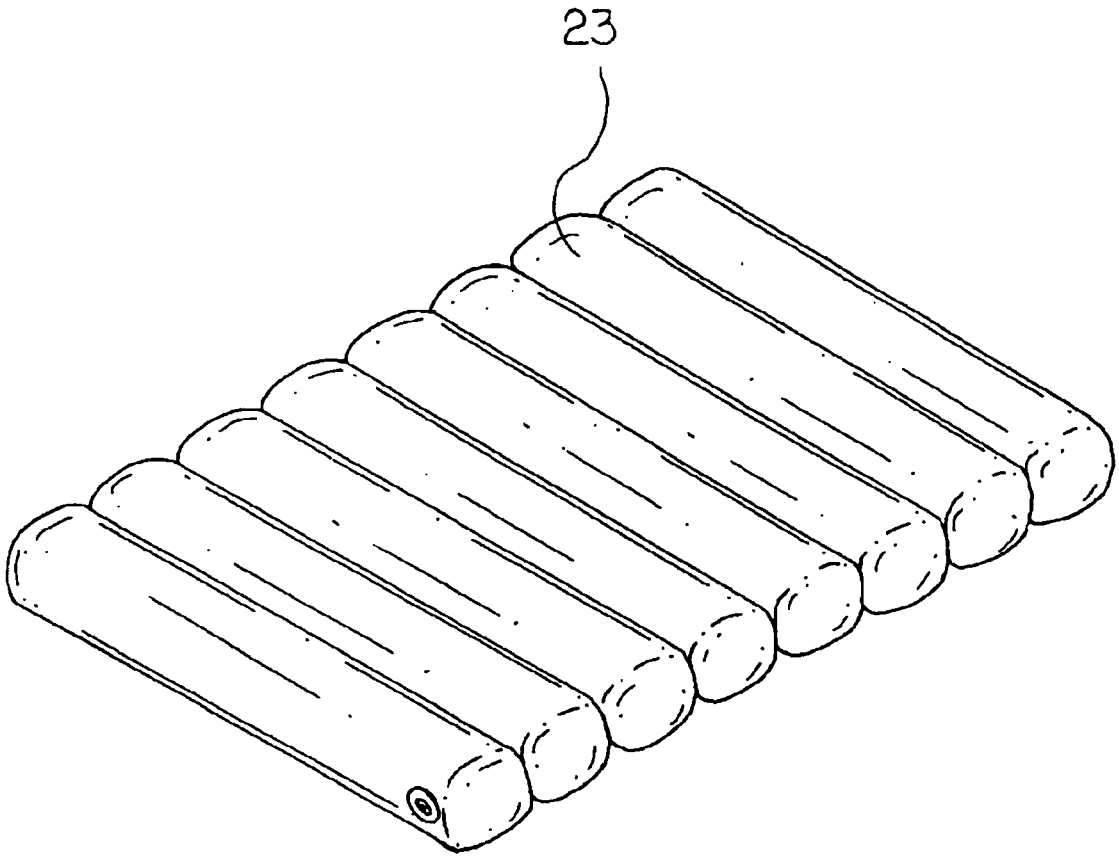
FIG. 3 is a perspective view of an air-cushioning bottom support of the portable playyard according to the above preferred embodiment of the present invention.
Figure 4:
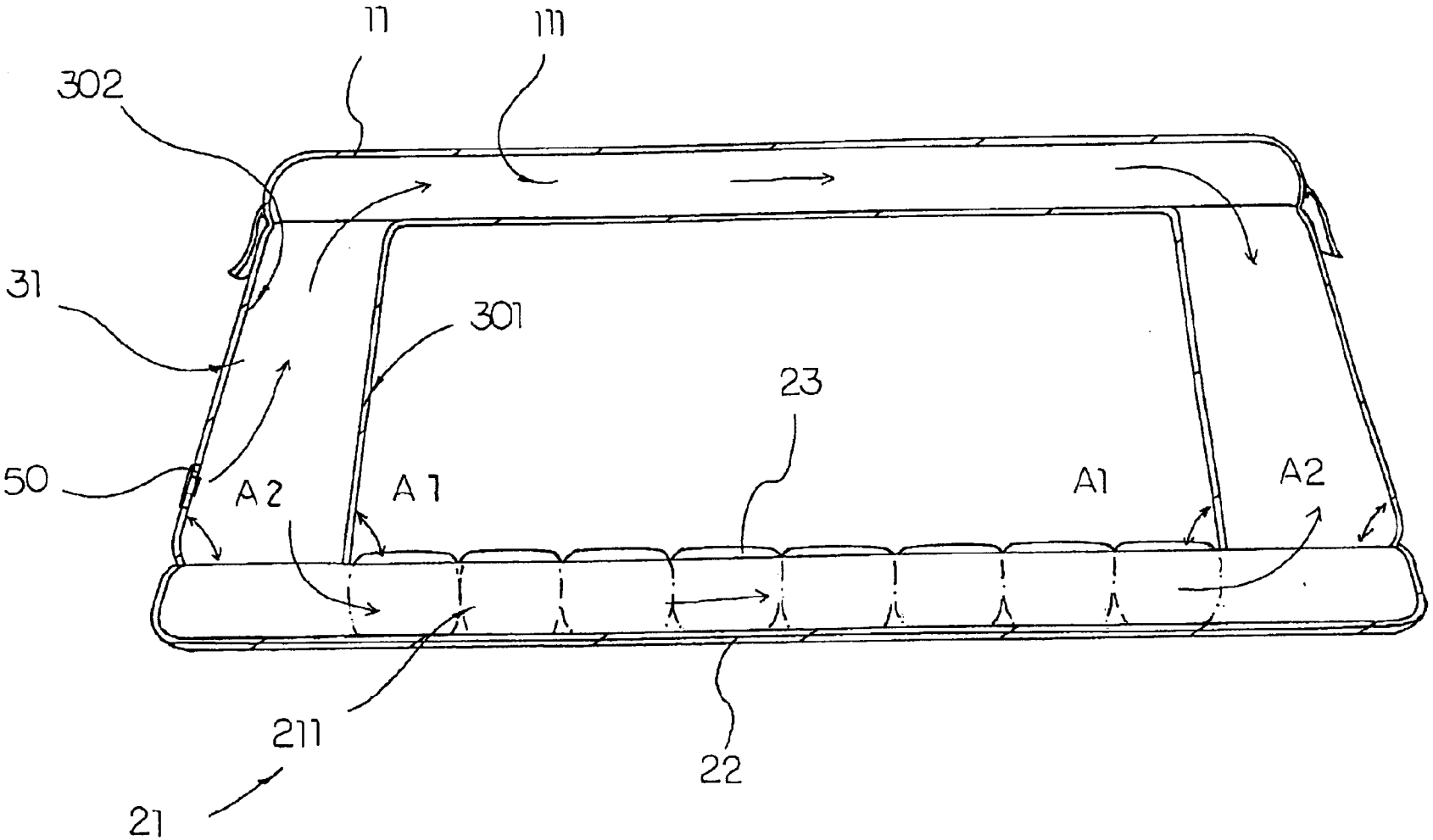
FIG. 4 is a sectional view of the portable playyard according to the above preferred embodiment of the present invention.

Referring to FIGS. 2 to 4 of the drawings, a portable playyard according to a preferred embodiment of the present invention is illustrated, wherein the portable playyard comprises a top frame 10 defining a top opening 100, a bottom frame 20 positioning underneath the top frame 10, a plurality of circular inflatable supporters 30 spacedly bridging the top and bottom frames 10, 20 and defining an interior space between the top and bottom frames 10, 20, and a boundary shelter 40 supported by the top frame to surround the interior space and define a playyard cavity 41 within the boundary shelter 40, the top frame 10, and the bottom frame 20.

Each of the inflatable supporters 30, having an air chamber 31, is outwardly and inclinedly extended from the top frame 10 to the bottom frame 20 to define an interior adjacent angle A1 and an exterior adjacent angle A2 which is smaller than the interior adjacent angle A1. The interior adjacent angle A1 is defined between an interior peripheral edge 301 of the respective inflatable supporter 30 and the bottom frame 20, wherein the exterior adjacent angle A2 is defined between an exterior peripheral edge 302 of the respective inflatable supporter 30 and the bottom frame 20. A diameter of each of the inflatable supporters 30 is gradually increased from a top portion of the inflatable supporter to a bottom portion thereof.

The portable playyard further comprises at least an air valve 50 provided at the inflatable supporters 30 for retaining a predetermined volume of air within the air chamber 31 of each of the inflatable supporters 30.

According to the preferred embodiment, the top frame 10 comprises an inflatable top boundary frame 11, having an air cavity 111, defining the top opening 100 therewithin wherein the inflatable supporters 30 are spacedly connected to the top boundary frame 11.

The bottom frame 20 comprises an inflatable bottom boundary frame 21 having an air compartment 211 and a bottom wall 22 mounted within the bottom boundary frame 21 wherein the inflatable supporters 30 are spacedly connected to the bottom boundary frame 21.

Each of the inflatable supporters 30 is extended from the top boundary frame 11 to the bottom boundary frame 21 wherein the air cavity 111 of the top boundary frame 11 is communicating with the air compartment 211 of the bottom boundary frame 21 through the air chambers 31 of the inflatable supporters 30 for allowing the air passing from the air cavity 111 to the air compartment 211 through the air chambers 31 while the air is pumped into the air chamber 31 via the air valve 50.

The air valve 50 is provided at one of the inflatable supporters 30 wherein the air valve 50 is an inflatable air valve for introducing the air into the respective air chamber 31 so as to inflate the top boundary frame 11, the bottom boundary frame 21, and the inflatable supporters 30 all at once.

As shown in FIGS. 3 and 4, the bottom frame 20 further comprises an inflatable bottom support 23 disposed within the bottom boundary frame 21 on the bottom wall 22 to provide an air-cushioning bottom support of the playyard cavity 41 for supporting a user, such as a young child, thereon.

Accordingly, the top boundary frame 11, having a rectangular shaped, has a size smaller than the bottom boundary frame 21 having the corresponding shaped, wherein each of the inflatable supporters 30 is inclinedly extended from the top boundary frame 11 to the bottom boundary frame 21.

As shown in FIG. 4, each of the inflatable supporters 30 having a tubular shaped has a cross section gradually reduced from the top portion to the bottom portion such that the diameter of each of the inflatable supporters 30 is gradually increased from the top portion of the inflatable supporter to the bottom portion thereof, thereby providing structural strength to maintain the portable playyard in a shape.

Each of the inflatable supporters 30 has the interior peripheral edge 301 extended from the top boundary frame 11 to the bottom boundary frame 21 within the playyard cavity 41 and the exterior peripheral edge 302 extended from the top boundary frame 11 to the bottom boundary frame 21 out of the playyard cavity 41. Since the size of each of the inflatable supporters 30 is gradually increased from the top portion to the bottom portion, the interior adjacent angle A1 and the exterior adjacent angle A2 of each inflatable supporter 30 are respectively formed at the interior and exterior peripheral edges 301, 302 thereof with respect to the bottom wall 22 of the bottom frame 20.

Figure 5:
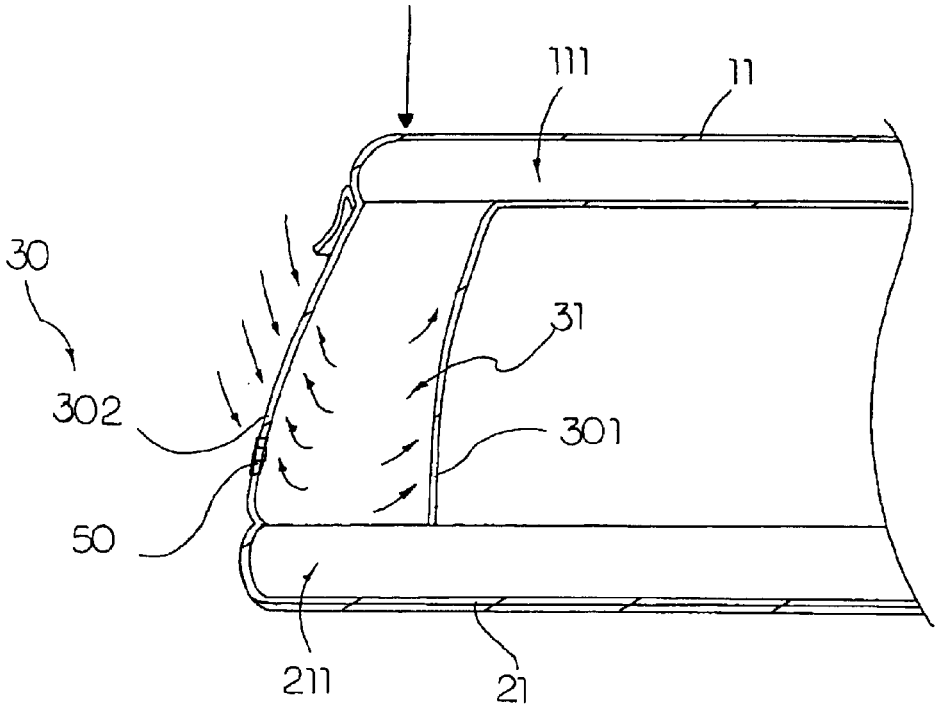
FIG. 5 is a sectional view of the inflatable supporter of the portable playyard according to the above preferred embodiment of the present invention.

When the air is sealedly retained the air chamber 31 of each of the inflatable supporters 30, the air having a predetermined air pressure is capable of urging against a deformation of the top portion of the inflatable supporter 30 when the downward force is applied thereon, as shown in FIG. 5. In other words, when a downward force is applied on the top frame 10, the air within the air chamber 31 upwardly withstands against the downward force to prevent the deformation of the inflatable supporter 30. Therefore, when the inflatable supporters 30 are inflated, the air within the air chambers 31 substantially supports the top frame 10 so as to prevent the portable playyard of the present invention from being accidentally collapsed.

In order to set up the portable playyard, an individual, such as a parent, is able to employ with a conventional air pump, such as electric air pump, hand pump, foot pump, or other apparatuses, operatively plug into the air valve 50 to pump the air into the air cavity 111, the air compartment 211, and the air chambers 31, so as to inflate the top frame 10, the bottom frame 20, and the inflatable supporters 30 respectively. In other words, the portable playyard of the present invention eliminates the trouble of connecting the rods and joints as the essential components of the conventional playyard.

Figure 6:
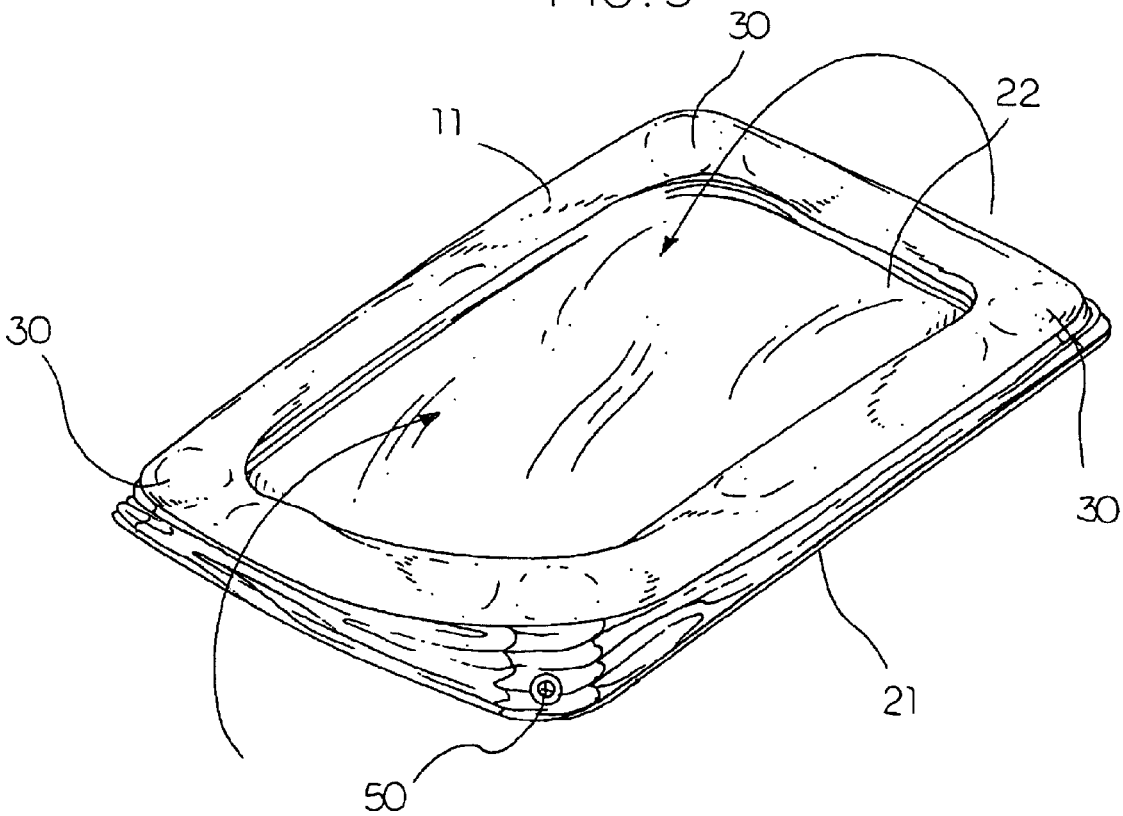
FIG. 6 is a perspective view of the deflated portable playyard according to the above preferred embodiment of the present invention.

Therefore, by deflating the top frame 10, the bottom frame 20, and the inflatable supporters 30 to minimize the air volume of the air cavity 111, the air compartment 211, and the air chambers 31 respectively, the portable playyard can be folded up and put into a bag for easy carriage and storage, as shown in FIG. 6.

It is worth to mention that the top boundary frame 11, the bottom boundary frame 21 and the inflatable supporters 30 are inflated by air that inevitably provides an air-cushioning effect for the portable playyard so that the child is safe to accommodate in the portable playyard of the present invention. In addition, the portable playyard of the present invention eliminates the use of metal rods, joints, screws, and bolts, infants and children who accommodate in the playyard cavity 41 are prevented from being hurt by the hardness and sharpness of theses components.

Figure 7:
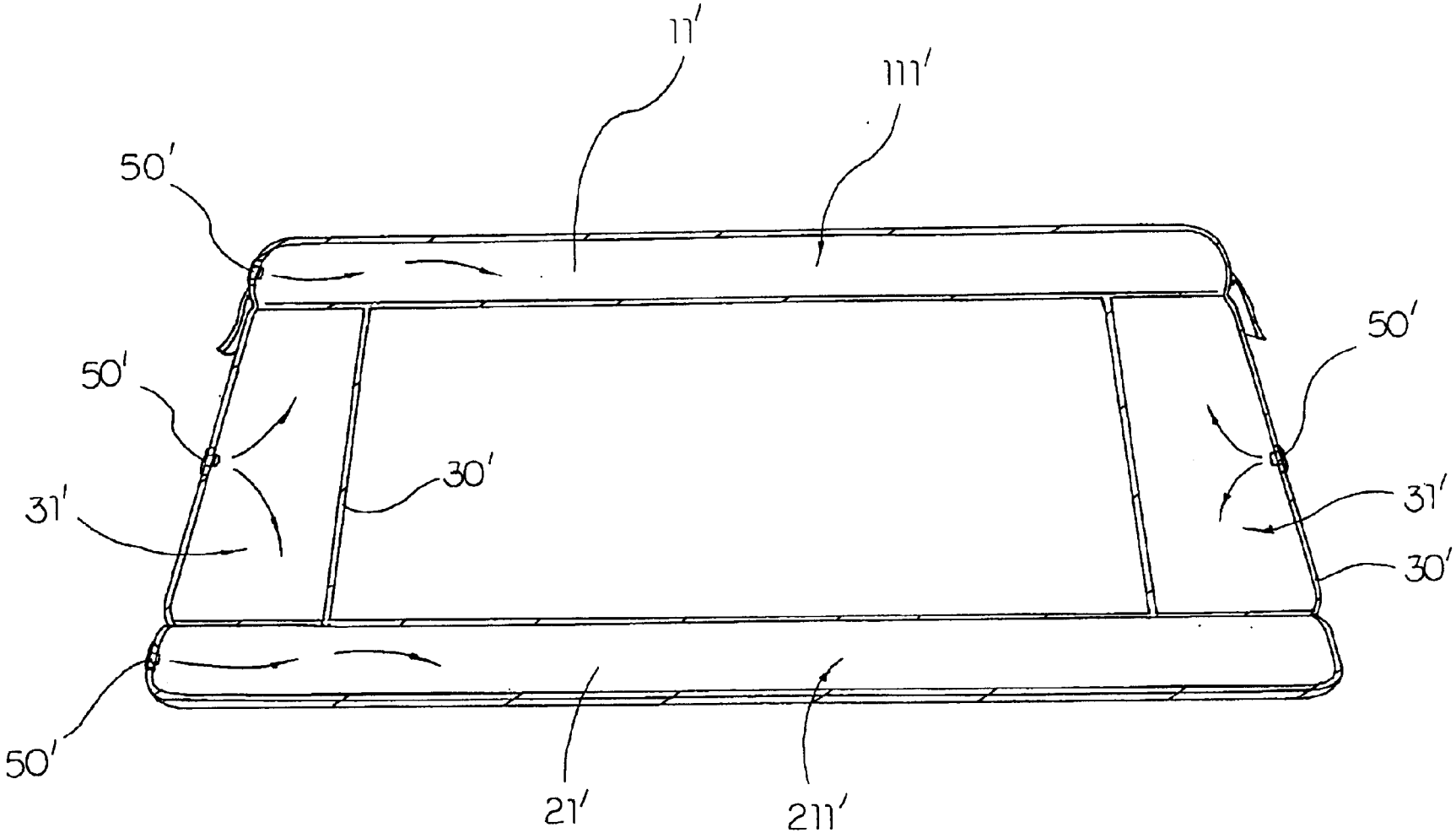
FIG. 7 illustrates an alternative mode of the inflatable supporter of the portable playyard according to the above preferred embodiment of the present invention.

As shown in FIG. 7, the top boundary frame 11', the bottom boundary frame 21', and the inflatable supporters 30' are constructed to be individual inflatable bodies, wherein the air valve 50' is provided at each of the top boundary frame 11', the bottom boundary frame 21' and the inflatable supporters 30' for sealedly retaining the air within each of the air cavity 111', the air compartment 211', and the air chambers 31', so as to individually inflate the top boundary frame 11', the bottom boundary frame 21' and the inflatable supporters 30'.

Therefore, the inflatable supporters 30' functions as individual air-cushioning supporters to support the top boundary frame 11'. In other words, each air chamber 31' can be adjustably filled with air to support the top boundary frame 11', so as to prevent the portable playyard from being accidentally collapsed when one of the top boundary frame 11', the bottom boundary frame 21', and the inflatable supporters 30' is air-leaking.

Figure 8:
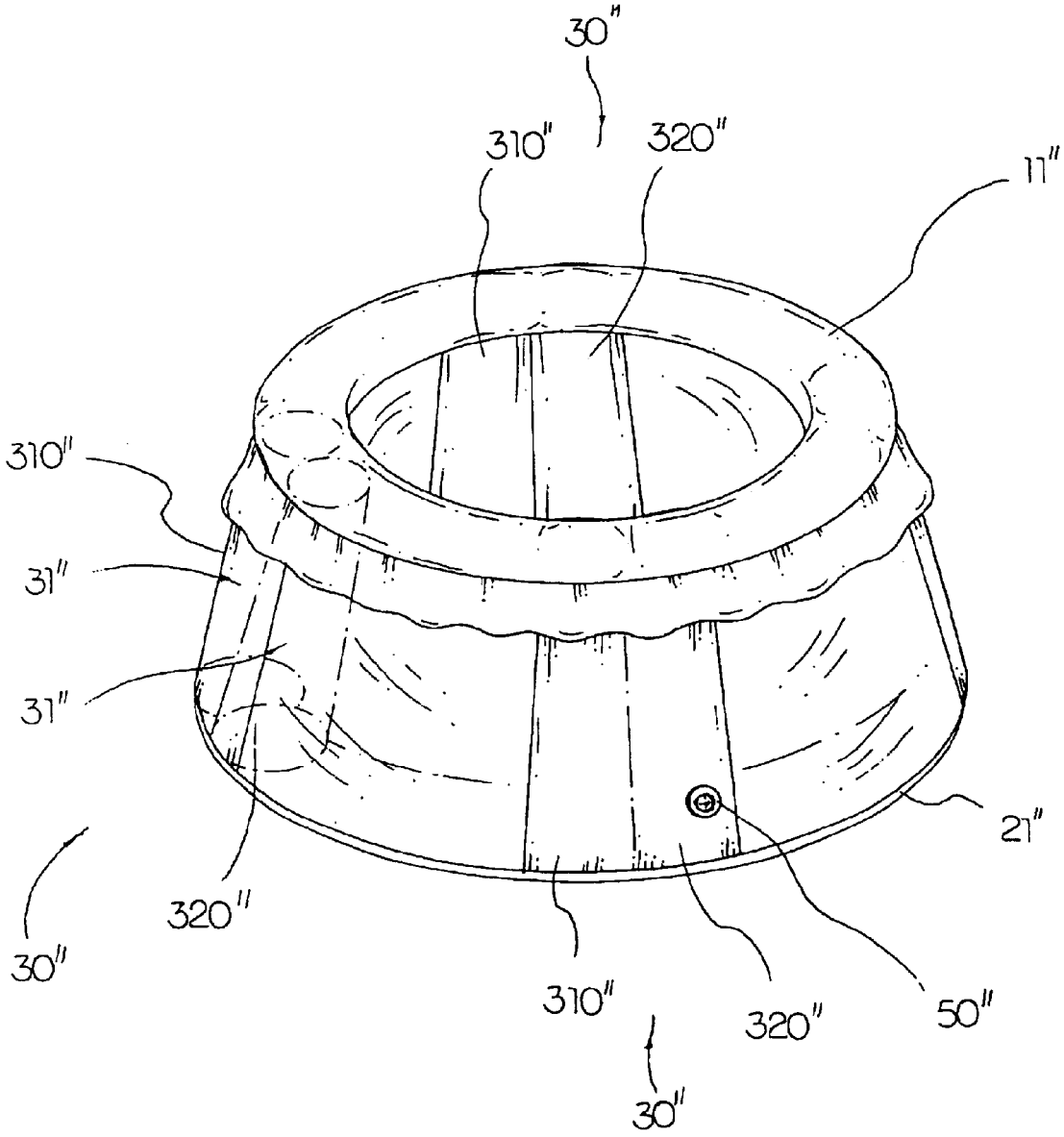
FIG. 8 illustrates an alternative mode of the portable playyard according to the above preferred embodiment of the present invention.

As shown in FIG. 8, the top boundary frame 11" and the bottom boundary frame 21" are in circular shape wherein each of the inflatable supporters 30" comprises a pair of inflatable pillars 310", 320" parallelly extended from the top boundary frame 11" to the bottom boundary frame 21". Therefore, when the air chambers 31" of the inflatable pillars 310", 320" are filled with air via the air valve 50", the inflatable pillars 310", 320" function as two air cushioning supporters to substantially support the top boundary frame 11".

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A portable playyard, comprising:

a top frame including an inflatable top boundary frame, having an air cavity, defining a top opening therewithin;

a bottom frame positioning underneath said top frame, wherein said bottom frame comprises an inflatable bottom boundary frame having an air compartment, a circumferential size larger than that of said top boundary frame, and a bottom wall mounted within said bottom boundary frame;

a plurality of inflatable supporters having a top portion spacedly connected to said top boundary frame and a bottom portion spacedly connected to said bottom boundary frame so as to spacedly bridging said top and bottom frames and defining an interior space between said top and bottom frames, wherein each of said inflatable supporters, having an air chamber, outwardly and inclinedly extends from said top frame to said bottom frame to define an interior adjacent angle and an exterior adjacent angle, wherein each of said inflatable supporters has a tubular shape and a cross section gradually reduced from said top portion to said bottom portion, wherein said cross section of each of said inflatable supporters, which is larger than cross sections of said top boundary frame and said bottom boundary frame, is gradually increased from said top portion to said bottom portion of said inflatable supporter, wherein said interior adjacent angle is defined between an interior peripheral edge of said respective inflatable supporter and said bottom frame and said exterior adjacent angle is defined between an exterior peripheral edge of said respective inflatable supporter and said bottom frame, wherein said both said interior adjacent angle and said exterior adjacent angle are smaller than 90 degrees and said exterior adjacent angle is smaller than said interior adjacent angle;

a boundary shelter supported by said top frame to surround said interior space and define a playyard cavity within said boundary shelter, said top frame, and said bottom frame; and at least an air valve provided at said inflatable supporters for retaining a predetermined volume of air within said air chamber of each of said inflatable supporters.

2. A portable playyard, as recited in claim 1, wherein said air cavity of said top boundary frame is communicating with said air compartment of said bottom boundary frame through said air chambers of said inflatable supporters for allowing said air passing from said air cavity to said air compartment through said air chambers.

3. A portable playyard, as recited in claim 2, wherein said air valve is provided at one of said inflatable supporters for introducing said air into said respective air chamber, so as to inflate said top boundary frame, said bottom boundary frame, and said inflatable supporters all at once.

4. A portable playyard, as recited in claim 3, wherein said bottom frame further comprises an inflatable bottom support disposed within said bottom boundary frame on said bottom wall to provide an air-cushioning bottom support of said playyard cavity.

5. A portable playyard, as recited in claim 2, wherein said bottom frame further comprises an inflatable bottom support disposed within said bottom boundary frame on said bottom wall to provide an air-cushioning bottom support of said playyard cavity.

6. A portable playyard, as recited in claim 1, wherein said top boundary frame, said bottom boundary frame, and said inflatable supporters are constructed to be individual inflatable bodies such that said inflatable supporters function as individual air-cushioning supporters to support said top boundary frame.

7. A portable playyard, as recited in claim 6, wherein said air valve is provided at each of said top boundary frame, said bottom boundary frame and said inflatable supporters for sealedly retaining said air within each of said air cavity, said air compartment, and said air chambers, so as to individually inflate said top boundary frame, said bottom boundary frame and said inflatable supporters.

8. A portable playyard, as recited in claim 7, wherein said bottom frame further comprises an inflatable bottom support disposed within said bottom boundary frame on said bottom wall to provide an air-cushioning bottom support of said playyard cavity.

9. A portable playyard, as recited in claim 6, wherein said bottom frame further comprises an inflatable bottom support disposed within said bottom boundary frame on said bottom wall to provide an air-cushioning bottom support of said playyard cavity.

10. A portable playyard, as recited in claim 1, wherein said bottom frame further comprises an inflatable bottom support disposed within said bottom boundary frame on said bottom wall to provide an air-cushioning bottom suport of said playyard cavity.

* * * * *